United States Patent [19]

Wimmer

[11] Patent Number: 4,468,215

[45] Date of Patent: Aug. 28, 1984

[54] CENTRIFUGE

[76] Inventor: Otto Wimmer, 8399 Sulzbach/Inn, Bundesrepublik, Fed. Rep. of Germany

[21] Appl. No.: 270,527

[22] PCT Filed: Oct. 19, 1979

[86] PCT No.: PCT/DE79/00122

§ 371 Date: Jun. 19, 1981

§ 102(e) Date: Jun. 9, 1981

[87] PCT Pub. No.: WO81/01113

PCT Pub. Date: Apr. 30, 1981

[51] Int. Cl.[3] ..... B04B 11/00

[52] U.S. Cl. ..... 494/48; 494/56

[58] Field of Search ..... 494/56, 38, 43, 48, 494/2; 233/27, 20 R, 20 A

[56] References Cited

U.S. PATENT DOCUMENTS 3,986,663 10/1976 Jonsson ..... 233/20 A

FOREIGN PATENT DOCUMENTS 2150605 8/1974 Fed. Rep. of Germany .

*Primary Examiner*—Robert W. Jenkins

*Attorney, Agent, or Firm*—Kerkam, Stowell, Kondracki & Clarke

[57] ABSTRACT

Centrifuge and in particular a tubular conifuge for the purification of liquids and for the concentration of sludge, the centrifuge consists of two drum halves and one axially displaceable tube or shell connecting the drum halves, with axial introduction of the material to be treated. At least part of one of the drum halves is axially displaceable during the run of the centrifuge for the purpose of reducing the inner drum space.

6 Claims, 2 Drawing Figures

CENTRIFUGE

BACKGROUND OF THE INVENTION

The present invention relates to a centrifuge, and in particular a tubular conifuge for the purification of liquids and for sludge concentration, whose centrifuge drum consists of two drum halves and a tube, connecting these two halves, being axially displaceable, with an axial input for the solid material.

While it is possible to achieve good solid matter concentrations with tubular configues, when comparing the results to those obtained by means of regular centrifuges, they are still clearly below those obtained by means of filter presses, to give an example. The cause for this lies in the fact that in centrifuges the solid material becomes subject to but limited concentration because viscosity moves radially towards the center. In addition, when the centrifuge is filled there is evidence of certain clouding after some time of operation, and the solid matter separation stops.

It is therefore a principal object of the invention to improve operation of a centrifugal machine of the type described in such a manner that increased solid matter concentrations can be achieved.

SUMMARY OF THE INVENTION

The present invention accomplishes the aforenote subject by making at least part of at least one of the drum halves axially displaceable during the centrifuge run. The improved design of the present invention makes it possible that during the centrifuge run, and preferably towards the end of the operation, the inner drum volume may be reduced and thus the solid matter is compressed, so that clear liquid or liquid with very low solid matter concentration, respectively, is extracted and enters the overflow or the inlet, to be removed in the conventional manner. The results are increased in the solid matter concentration corresponding to the volume reduction.

BRIEF DESCRIPTION OF THE DRAWINGS

These and other features of the invention and the attendant advantages will be apparent to those having ordinary skill in the art and the invention will be more easily understood from the following detailed description then in conjunction with the accompanying drawings.

DESCRIPTION OF THE PREFERRED EMBODIMENTS

Figure 1:
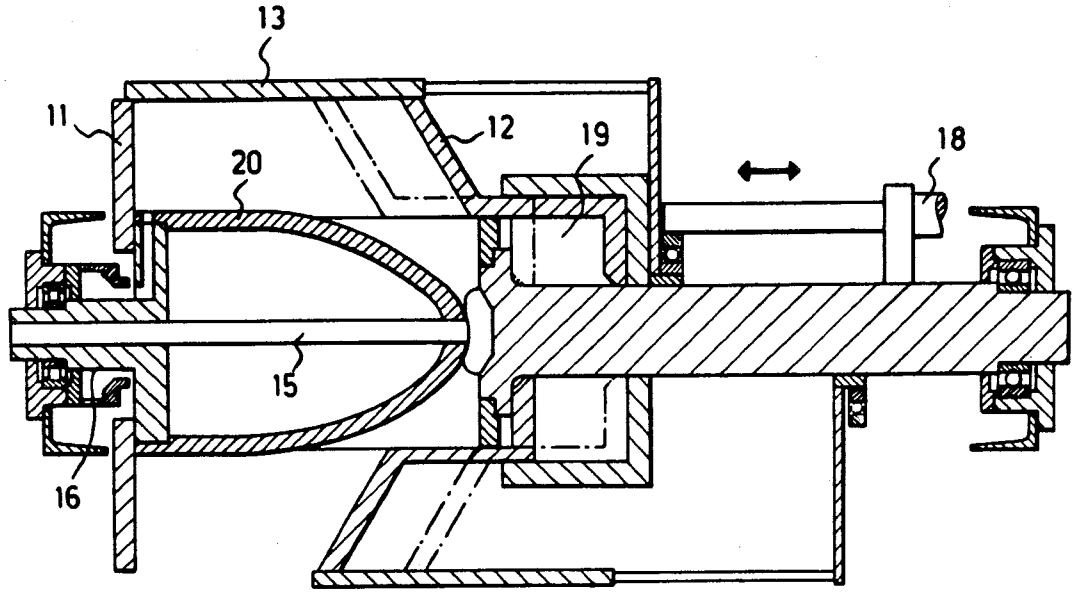
FIG. 1 shows the cross section of the tubular conifuge.

The tubular conifuge of FIG. 1 consists of one axially separate drum halves 11, 12, rotatably arranged with respect to the displacement body 20. Both of the drum halves are connected by means of a shell or tube 13 which is closed at one end and is axially displaceable by means of a doubly activating hydraulic cylinder 18. By the axial displacement of this tube 13, the dry matter located within the drum can be spun off.

From its initial position, which drum half 12 assumes whenever the centrifuge drum is filled, a hydraulic cylinder 19 can be actuated to displace said drum toward the other, fixed, drum half 11 in the axial direction, so that the inner drum volume can be reduced.

Referring to FIG. 1, it may help in understanding the operation of the invention to further explain this figure and the manner in which the parts are shown in their various positions. Firstly, on the upper side of the Figure, drum half 12 is shown in its fully extended position, that is with maximum volume for the inner drum space. Directly across on the lower side, the corresponding sloping section of drum half 12 is shown in phantom lines. The second position or reduced volume position of the drum half is shown in solid lines on the lower side of the drawing and the corresponding upper side section is shown in phantom lines. This reflects that the drum half has been axially displaced downwardly in the second position, as seen in the drawing, to reduce the inner volume and thereby compressing the contents within the inner drum space.

Likewise, the position of the shell or tube 13 has been shown both in its closed and open position. On the upper side of the drawing, shell 13 is shown disposed between drum halves 11 and 12 to designate the closed position. The shell is axially displaceable as shown on the lower side of the drawing to open the inner drum space and to allow the contents therein to be extracted upon continued rotation of the centrifuge. The inner drum space is the space confined by the sloping section of the drum 12, the side wall of the shell 13 and the outer wall of displacement body 20. When the shell 13 is raised, dry matter within the drum can be spun off.

During operation, parts 11, 12 and 13 form the inner drum space about body 20, the space having a fixed volume. Part 12 can be axially displaced to reduce the inner space or volume and compress the contents after the solids have been separated from the liquids by centrifuging. Shell 13 can be displaced to provide an exit opening so that the solids can be centrifuged out of the drum.

During the operation of the machine, the material to be treated is fed into one end of the inner drum space through a channel 15. After introduction into the drum, this material is affected by the centrifugal force of the centrifuge, so that the solid matter forms a radially outside deposit and the fluid, or clarified substance may be drawn off through a mouth 16. A filter may be arranged on a displacement body 20 arranged within the inner drum space, through which the clarified substance reaches the mouth 16. By the axial displacement of drum half 12, it becomes possible to compress the radially deposited solid matter so that it gives off clear liquid towards the inside, thereby increasing the solid matter concentration of the substance within the drum. The displaceable drum half 12 suitably is so designed that it closes the inlet into the centrifuge drum, coming from the displacement body 20, whenever said body moves to reduce the interior space of the drum so that no new material can enter the drum during the final phase of its run. It is also practical that a sieve or a filter be arranged on the displacement body 20, at least in the area of the mouth, not only for the purpose of filtering, but also to effect a rise in pressure within the inlet after a certain operating time, which pressure is to be used for the control of the centrifugal machine.

Figure 2:
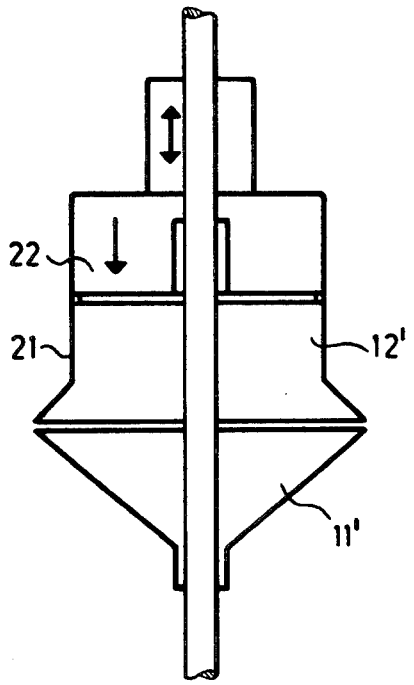
FIG. 2 shows a cross section diagramatic view through a double tubular conifuge

FIG. 2 shows the application of the principle of the reduction of the inner space of a drum of a double tubular conifuge, or a separator. The centrifuge consists of two drum halves 11', 12', having a vertical axis, the drum half 12' again being displaceably arranged against drum half 11' in a conventional manner, for the purpose of opening the centrifuge. Drum half 12' has a cylindrical extension 21 in which a plunger 22 is moveably arranged to reduce the inner drum space.

I claim:

1. A centrifuge for treating material and, in particular, a centrifuge of the tubular conifuge type for the purification of liquids and for the concentration of sludge comprising a centrifuge drum; said drum consisting of a first drum halve, a second drum halve and a cylindrical shell disposed between said first and said second drum halves and forming with said drum halves an inner drum space for receiving materials to be treated, means for mounting said drum for rotation about a fixed axis, said means including an axial passage opening into said inner drum space for introduction of material to be treated into said drum space and a radial passage exiting from said inner drum space for extraction of liquid material from said inner drum space, said cylindrical shell being axially displaceable for opening of said inner drum space to allow extraction of solid material, means for axially displacing said cylindrical shell, said first drum halve being axially displaceable relative to said shell and to said second drum halve during the run of the centrifuge for reducing the volume of the inner drum space and means for axially displacing said first drum halve.

2. A centrifuge as set forth in claim 1 wherein said means for axially displacing said shell and said means for axially displacing said first drum halve comprises a hydraulic, pneumatic, electric or mechanical operating mechanism.

3. A centrifuge as set forth in claim 1 wherein said first and said second drum halves are discs.

4. A centrifuge as set forth in claim 1 wherein said first and said second drum halves are conical in shape.

5. A centrifuge as set forth in claim 4 wherein said first drum halve further includes a cylindrical extension and plunger means arranged for displacement within said extension for reducing the volume of the inner drum space.

6. A centrifuge as set forth in claim 1 further including a displacement body in said inner drum space, said axial passage extending through said displacement body.

* * * * *